US009062538B2

(12) United States Patent
Arellano et al.

(10) Patent No.: US 9,062,538 B2
(45) Date of Patent: Jun. 23, 2015

(54) SYSTEM, APPARATUS AND METHOD FOR DELIQUEFYING PRODUCED FLUIDS FROM A WELL

(75) Inventors: Jose Luis Arellano, Houston, TX (US); Kenneth Carmon, Richmond, TX (US)

(73) Assignee: Chevron U.S.A. Inc., San Ramon, CA (US)

( * ) Notice: Subject to any disclaimer, the term of this patent is extended or adjusted under 35 U.S.C. 154(b) by 805 days.

(21) Appl. No.: 13/274,931

(22) Filed: Oct. 17, 2011

(65) Prior Publication Data

US 2013/0092373 A1 Apr. 18, 2013

(51) Int. Cl.
*E21B 43/12* (2006.01)

(52) U.S. Cl.
CPC ..... *E21B 43/121* (2013.01)

(58) Field of Classification Search
CPC ... E21B 34/06; E21B 41/0078; E21B 43/121; E21B 43/122; E21B 43/123
USPC ..... 166/369, 372, 316
See application file for complete search history.

(56) References Cited

U.S. PATENT DOCUMENTS

| | | | | |
|---|---|---|---|---|
| 7,051,817 | B2 * | 5/2006 | Shaposhnikov et al. | 166/372 |
| 7,287,597 | B2 * | 10/2007 | Shaposhnikov et al. | 166/372 |
| 7,506,690 | B2 * | 3/2009 | Kelley | 166/372 |
| 8,122,966 | B2 * | 2/2012 | Kelley | 166/372 |
| 2004/0129428 | A1 * | 7/2004 | Kelley | 166/372 |
| 2011/0067883 | A1 * | 3/2011 | Falk et al. | 166/369 |

* cited by examiner

*Primary Examiner* — Catherine Loikith
(74) *Attorney, Agent, or Firm* — Nicholas F. Gallo

(57) ABSTRACT

An apparatus, system, and method are provided for deliquefying a produced fluid being produced from a gas well. The apparatus can be a nozzle configured to be disposed in a production tube extending from a subsurface gas reservoir to a surface location and configured to provide a pathway for transmission of the produced fluid from the reservoir to the surface location. The nozzle generally can define a first end for receiving the produced fluid from the reservoir, a second end distal to the first end, and an inner surface extending between the ends. The inner surface can define an inwardly tapered inlet portion at the first end, an outwardly tapered outlet portion proximate the second end, and a venturi neck portion between the inlet and outlet portions. The nozzle can be configured to reduce the pressure of the produced fluid and thereby deliquefy the produced fluid passing therethrough.

21 Claims, 4 Drawing Sheets

SYSTEM, APPARATUS AND METHOD FOR DELIQUEFYING PRODUCED FLUIDS FROM A WELL

FIELD OF THE INVENTION

The present invention is generally related to the production of fluids from a well and, more particularly, to the deliquefying of a fluid being produced from a well by passing the produced fluid through a nozzle.

BACKGROUND OF THE INVENTION

Fluids produced from wells often include multiple phases. For example, a conventional gas well can be used to produce hydrocarbon gases from a subterranean reservoir to a surface location. The reservoir where the gas is found may also contain liquids, such as water or hydrocarbon liquids. In a typical completion of a gas well, a tubular casing having one or more radial layers is disposed from the surface location to or through the reservoir. A production tube or string, typically a steel pipe, is disposed within the casing, typically with an annulus defined between the outside of the production tube and the innermost well casing. At depth, the outer surface of the production tube is sealed to the inner surface of the casing by packers so that the production tube provides a pathway from the reservoir to the surface location, and all produced fluid flowing through the well from the reservoir to the surface location flows through the production tube. The casing is perforated to admit the produced fluid from the reservoir into the production tube.

Gas and liquid that are present in the reservoir may enter the casing. During a typical operation of a gas well, the level of water or other liquids in the casing is below the inlet of the production tube. Nevertheless, the flow of gas into the production tube may carry some liquid with it, a phenomenon referred to as "liquid loading" of the produced gas. Liquid loading can occur in different ways. For example, if liquid resides in the casing and the upper level of the liquid is near the inlet of the production tube, the flow of the gas into the production tube may disturb the upper level of the liquid and draw the liquid into the production tube. In fact, the upper level of the liquid in the immediate vicinity of the production tube may be temporarily pulled up to the inlet of the production tube. The liquid may temporarily block the gas from entering the production tube. In this way, a distinct "slug" of liquid may be drawn into the tube before the level of the liquid in the casing falls back down, and the slug then passes upward through the tube with the gas.

Alternatively, even if the upper level of the liquid remains below the inlet of the production tube, the gas may carry some liquid. In some cases, the liquid can be carried first in a gaseous phase, e.g., as water vapor, that liquefies as the produced fluid travels through the production tube. As the vapor liquefies, it can form a mist, i.e., small droplets suspended in the gas. Mist-like droplets of the liquid can also be present in the gas as it enters the production tube. In either case, the droplets of liquid typically tend to combine and form larger drops of liquid in the produced fluid. Thus, as the produced fluid travels through the production tube, the liquid content may increase and may become more difficult to lift, thereby reducing the flow rate of the well. The liquid content in the produced fluid may even stop the production of gas from the well until sufficient pressure builds.

A number of conventional methods exist for deliquefying a produced fluid during production or otherwise increasing the flow rate of a gas producing well. Artificial lift can be provided to the well, such as by injecting a lift gas at high pressure into the annulus of the well so that the lift gas enters the production tube at a particular depth and helps lift the produced fluid with it through the production tube. Alternatively, a plunger- or rod-type pump can be used to draw gas from a well. Another conventional method includes injecting a diluent material or other chemical into the well to facilitate gaseous production. While such conventional methods can be successful in facilitating production in some gas wells, there exists a continued need for improvements to produce fluids from a well production, particularly in the production of gas from reservoirs that include some liquids.

SUMMARY OF THE INVENTION

The present invention provides an apparatus, system, and method for deliquefying a produced fluid being produced from a gas well.

According to one embodiment, the apparatus is provided as a nozzle that is configured to be disposed in a production tube that extends from a subsurface gas reservoir to a surface location and configured to provide a pathway for transmission of the produced fluid from the reservoir to the surface location. The nozzle defines a first end for receiving the produced fluid from the reservoir, a second end distal to the first end, and an inner surface extending between the first and second ends. The inner surface defines an inwardly tapered inlet portion at the first end, an outwardly tapered outlet portion proximate the second end, and a venturi neck portion between the inlet and outlet portions, so that the nozzle is configured to reduce the pressure of the produced fluid and thereby deliquefy the produced fluid as the produced fluid passes through the nozzle.

In some cases, the inner surface is a smooth, continuous surface extending through the inlet portion, the venturi neck portion, and the outlet portion. An inner diameter of the neck portion of the nozzle can be less than one-fifth of an outer diameter of the nozzle, where the outer diameter corresponds to an inner diameter of the production tube. The axial length of the inlet portion of the nozzle can be shorter than an axial length of the outlet portion of the nozzle. The nozzle can define an engagement feature near the second end, the engagement feature being configured to be engaged by a retrieval tool. For example, the engagement feature can be a threaded inner surface of the nozzle that is configured to engage corresponding outer threads of the retrieval tool, or the engagement feature can be a slotted inner surface of the nozzle, the slot defined by a shoulder extending radially inward and configured to engage the retrieval tool.

According to another embodiment, the system is provided as a production tube extending from a subsurface gas reservoir to a surface location and configured to provide a pathway for transmission of the produced fluid from the reservoir to the surface location. At least one nozzle is disposed in the production tube, e.g., with an outer surface of the nozzle that is configured to engage an inner surface of the production tube and form a seal with the production tube so that the produced fluid passing through the production tube is directed through the nozzle. The nozzle defines a first end for receiving the produced fluid from the reservoir, a second end distal to the first end, and an inner surface extending between the first and second ends. The inner surface defines an inwardly tapered inlet portion at the first end, an outwardly tapered outlet portion proximate the second end, and a venturi neck portion between the inlet and outlet portions so that the nozzle is configured to reduce the pressure of the produced fluid and thereby deliquefy the produced fluid as the produced fluid passes through the nozzle. In some cases, a plurality of the nozzles are disposed at spaced locations along a length of the production tube so that the produced fluid passes successively through each of the nozzles and is deliquefied in each nozzle.

According to another embodiment, the method includes providing a production tube extending from a subsurface gas reservoir to a surface location, and providing at least one nozzle disposed in the production tube. The nozzle defines a first end for receiving the produced fluid from the reservoir, a second end distal to the first end, and an inner surface extending between the first and second ends, the inner surface defining an inwardly tapered inlet portion at the first end, an outwardly tapered outlet portion proximate the second end, and a venturi neck portion between the inlet and outlet portions. The produced fluid is received through the production tube along a pathway between the reservoir and the surface location so that the produced fluid passes through the nozzle, a pressure of the produced fluid is reduced in the nozzle, and the produced fluid is deliquefied as the produced fluid passes through the nozzle.

In some cases, a plurality of the nozzles are provided at spaced locations along a length of the production tube so that the produced fluid passes successively through each of the nozzles and is deliquefied in each nozzle.

Each nozzle can be provided in the production tube by lowering the nozzle into the production tube while the production tube extends between the subsurface gas reservoir and the surface location. After the nozzle is used to receive and deliquefy the produced fluid in a production operation, a retrieval tool can be inserted into the production tube, engaged to the nozzle, and used to move the nozzle in the production tube.

DETAILED DESCRIPTION

The present invention now will be described more fully hereinafter with reference to the accompanying drawings, in which some, but not all embodiments of the invention are shown. Indeed, this invention may be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Figure 1:
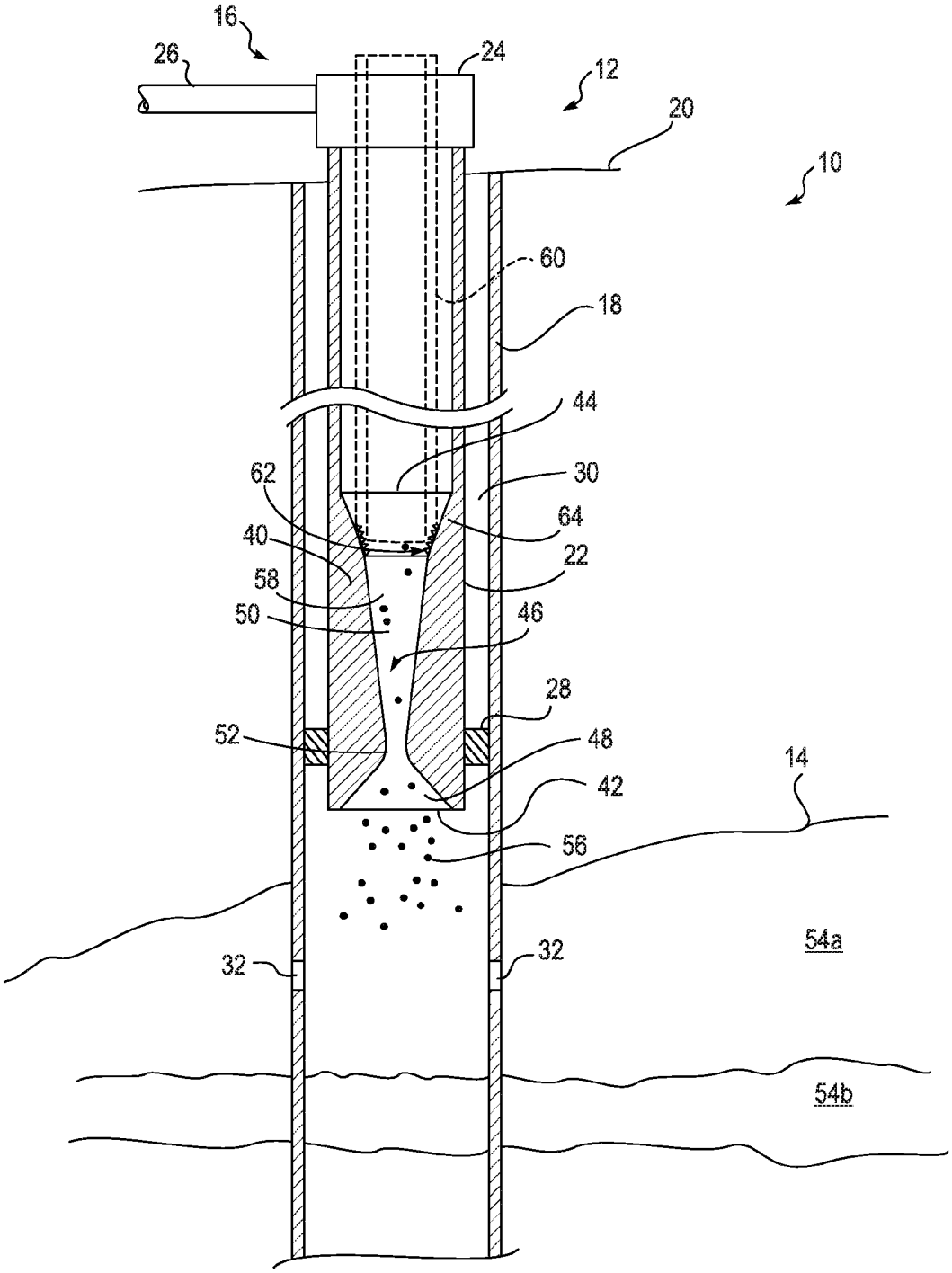
FIG. 1 is cross-sectional view illustrating a system for deliquefying a produced fluid being produced from a gas well according to one embodiment of the present invention.

Referring to FIG. 1, there is shown a system 10 for deliquefying a produced fluid that is being produced from a gas well 12 that produces a stream of produced fluid from a subsurface gas reservoir 14 to a surface location 16. The well 12 generally includes a casing 18 that extends from the surface location 16 downward from the ground surface 20 at least to the depth of the reservoir 14. The casing 18 may include one or more radially concentric layers, though a single layer is shown in FIG. 1 for illustrative clarity. Also, while the casing 18 is arranged in a linear and vertical configuration in FIG. 1, it is appreciated that the well 12 can be otherwise configured, e.g., extending at an angle or defining curves or angles so that different portions of the well 12 extend along different directions. For example, in some cases, the well 12 can include portions that are generally vertical in configuration and/or portions that are generally horizontal in configuration.

A production tube 22, which is typically made up of steel pipe segments welded end-to-end, is disposed in the casing 18. The production tube 22 extends from the reservoir 14 to the surface location 16. The production tube 22 is configured to receive the produced fluid from the reservoir 14 and transmit the produced fluid to the surface location 16. A Christmas tree or other wellhead equipment 24 can be connected to the production tube 22 at the surface location 16 and configured to receive the produced fluid for processing, storage, and/or further transport. For example, the wellhead equipment 24 can be connected to a flowline 26 that delivers the produced fluid from the well 12 to a processing or storage facility.

The production tube 22 can be sealed from the casing 18 by one or more packers 28. Each packer 28 extends circumferentially around the production tube 22 and radially between the outer surface of the production tube 22 and an inner surface of the innermost casing 18. In this way, the produced fluid can be prevented from flowing through the annulus 30 between the production tube 22 and the casing 18. Instead, the produced fluid flows through the production tube 22, as controlled by the wellhead equipment 24. Perforations 32 in the casing 18 allow the fluids from the reservoir 14 to flow into the casing 18, and, if the pressure in the reservoir 14 is sufficient, the reservoir pressure can cause the fluid to be produced through the well 12 to the wellhead equipment 24 at the surface location 16.

As illustrated in FIG. 1, a nozzle 40 is disposed in the production tube 22. The nozzle 40 defines a flow path for the produced fluid along the axial axis of the nozzle 40 and is generally configured to receive the produced fluid through a first end 42 and deliver the produced fluid from a second, opposite end 44. An inner surface 46 of the nozzle 40 extends between the first and second ends 42, 44 and defines a path of non-uniform cross-sectional area. More particularly, the inner surface 46 defines an inwardly tapered inlet portion 48 at the first end 42, an outwardly tapered outlet portion 50 proximate the second end 44, and a venturi neck portion 52 between the inlet and outlet portions 48, 50. Thus, as fluid flows through the nozzle 40, the fluid encounters a cross-sectional area that first decreases in the inlet portion 48 and then increases in the outlet portion 50. The inner surface 46 is typically a smooth, continuously, curved nozzle surface.

While the present invention is not limited to a particular theory of operation, it is believed that the nozzle 40 can facilitate the flow of produced fluid through the production tube 22 by increasing the speed of the flow of produced fluid, reducing the pressure of the produced fluid, and causing the produced fluid to deliquefy as it passes through the nozzle 40. By "deliquefy," it is meant that liquid drops in the produced fluid are caused to become reduced in size and/or turn to a gaseous form, such that the produced fluid exiting the nozzle 40 is better able to flow upward in the production tube 22.

The reservoir 14 can include gas 54*a*, such as natural gas, as well as liquids 54*b*, such as water. In a typical operation, the produced fluid for a gas well can be primarily gas, such as natural gas. The produced fluid may include a small water component, and the water may exist as vapor and/or droplets suspended in the gas. As the produced fluid flows upward through the production tube 22, the water content may tend to liquefy, i.e., vaporous water may turn to liquid droplets and/or small droplets of water may coalesce to form larger water drops, thereby inhibiting the flow of the produced fluid. As illustrated in FIG. 1, the water drops in the produced fluid entering the nozzle 40 are deliquefied in the nozzle 40, such that the produced fluid exiting the nozzle 40 is characterized by less liquid content and/or smaller sized droplets as compared to the produced fluid entering the nozzle 40. In some cases, the produced fluid may enter the nozzle 40 as a gas that includes water drop (generally indicated by reference numeral 56) and exit the nozzle 40 as a mist of gas that includes small water droplets suspended therein and/or an increased level of water vapor (generally indicated by reference numeral 58).

Figure 2:
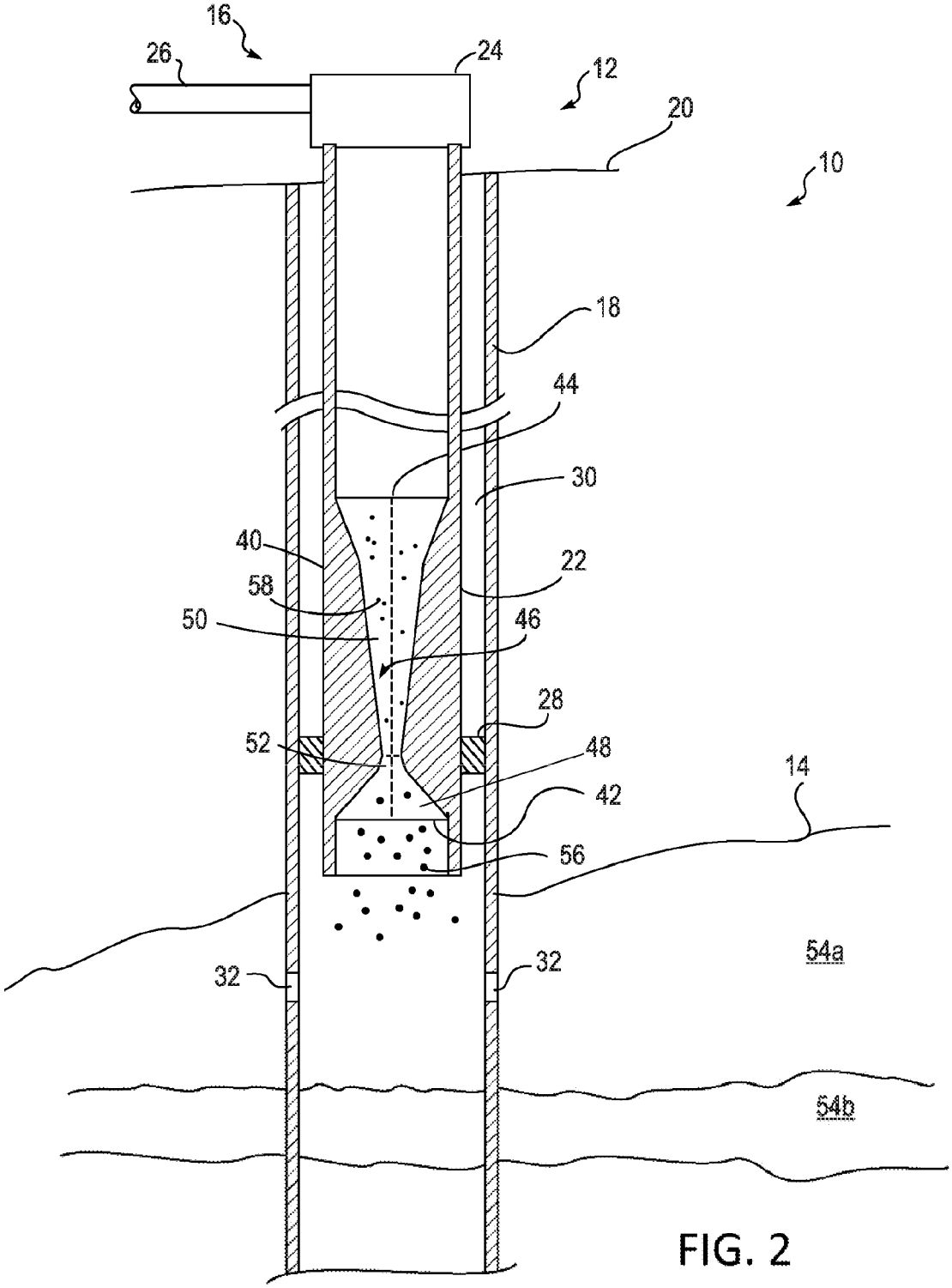
FIG. 2 is a cross-sectional view illustrating a system for deliquefying a produced fluid being produced from a gas well according to another embodiment of the present invention having a nozzle that is integral with the production tube.

The nozzle 40 can be formed integrally with the production tube 22 so that it is fixed in place in the tube 22, as shown in FIG. 2. For example, the nozzle 40 and the production tube 22 can be formed as a single, unitary member. In that case, the nozzle 40 can be installed in the well 12 as the production tube 22 is installed and, if desired, removed from the well 12 along with the production tube 22.

Alternatively, the nozzle 40 can be removably disposed in the production tube 22 and can be positioned in the production tube 22 at a desired location by engaging an outer surface of the nozzle 40 to the inner surface of the production tube 22, e.g., by a frictional fit or a mechanical connection, as shown in FIG. 1. The nozzle 40 can be disposed in the production tube 22 before or after the production tube 22 is inserted into the well 12. For example, with the production tube 22 in place in the well 12, but typically with the wellhead equipment 24 uninstalled, the nozzle 40 can be lowered into the production tube 22 using a retrieval tool 60 that is inserted into the production tube 22 until the nozzle 40 is at a desired location. The retrieval tool 60 can be engaged to the nozzle 40 during installation by corresponding engagement features on the nozzle 40 and tool 60, such as a threaded inner surface 62 of the nozzle 40 that is screwed to a threaded outer surface 64 of the retrieval tool 60, as shown in FIG. 1. After the tool 60 has been used to dispose the nozzle 40 in its desired position, the tool 60 can be disengaged from the nozzle 40 and removed, leaving the nozzle 40 in place.

In some cases, it may be desirable to move or remove the nozzle 40. For example, after production of the well 12, the conditions of the well 12 may change, the understanding of the well 12 conditions may improve, and/or the nozzle 40 or other well equipment may be damaged or worn. In such cases, the wellhead equipment 24 can be removed, and the retrieval tool 60 can be inserted into the production tube 22 and engaged to the nozzle 40 so that the tool 60 can be used to either move the nozzle 40 to a different location in the tube 22, replace the nozzle 40 with a different nozzle, or simply remove the nozzle 40 from the tube 22.

Figure 3:
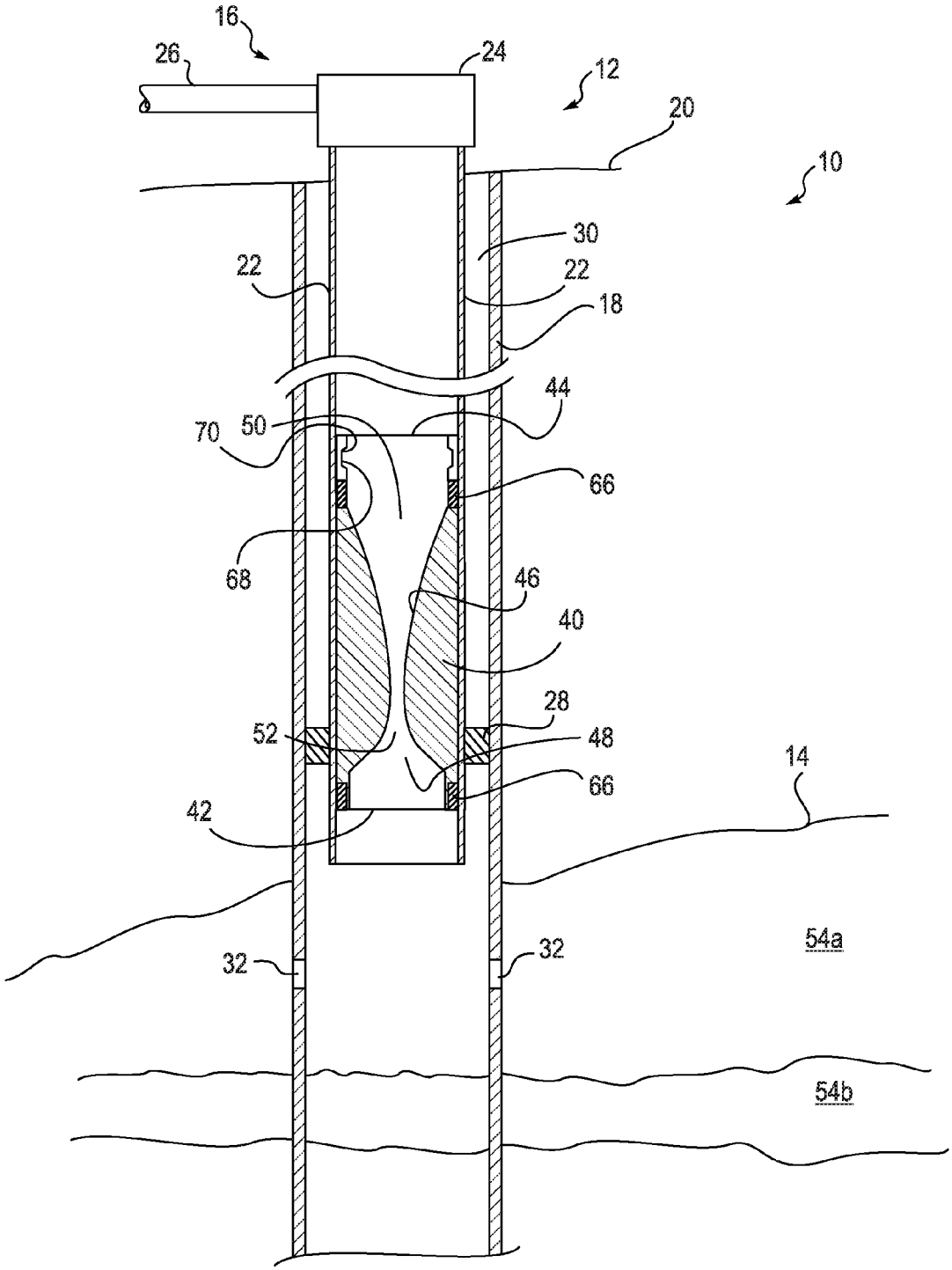
FIG. 3 is a cross-sectional view illustrating a system for deliquefying a produced fluid being produced from a gas well according to another embodiment of the present invention.

As shown in FIG. 3, the nozzle 40 can be provided with various dimensions and configurations, depending on the particular conditions of the well 12. In particular, the length and angle of the inlet, outlet, and neck portions 48, 50, 52 can be varied. In one embodiment, the smallest inner diameter of the nozzle 40 is defined by the neck portion 52 and is less than one-fifth of an inner diameter of the production tube 22, and, in some cases, less than one-tenth of the inner diameter of the production tube 22. For example, in one embodiment, if the production tube 22 has an inner diameter of 3.5 inches, the diameter defined by the neck portion 52 of the nozzle 40 can be between about 0.1 and 0.5 inches, such as about 0.35 inches.

The length of the inlet portion 48 of the nozzle 40, as measured in the axial direction of the nozzle 40, can be shorter than the length of the outlet portion 50 of the nozzle 40, also measured in the axial direction of the nozzle 40. In one embodiment, the axial length of the inlet portion 48 can be one-half or less of the axial length of the outlet portion 50. For example, in one embodiment, the axial length of the inlet portion 48 can be about half the inner diameter of the production tube 22, and the axial length of the outlet portion 50 can be twice the diameter of the production tube 22 or more. For example, if the inner diameter of the production tube 22 is 3.5 inches, the axial length of the inlet portion 48 can be about 1.75 inches, and the axial length of the outlet portion 50 can be at least 7 inches.

If the nozzle 40 is not integral with the production tube 22, additional connection members 66 can be provided on the nozzle 40 to facilitate the engagement of the nozzle 40 with the inner surface of the production tube 22, as shown in FIG. 3. For example, the connection members 66 can be a nitrile ring or a metal slip that holds the nozzle 40 in place. In some cases, the connection members 66 can be engaged or disengaged from the inner surface of the production tube 22 by pulling with slick line or jar down to lock the nozzle.

As also illustrated in FIG. 3, different configurations can be used to provide the engagement feature of the nozzle 40. In particular, in the embodiment of the nozzle 40 illustrated in FIG. 3, the engagement feature is a circumferential slot 68 or groove extending radially outward from the inner surface 46 of the nozzle 40, proximate the second end 44 of the nozzle 40. The slot 68 is defined by a shoulder 70 that extends radially and is configured to engage a retrieval tool, e.g., by a corresponding shoulder of the retrieval tool that can be actuated radially inward and outward to selectively engage or disengage the nozzle 40 during installation and removal.

Figure 4:
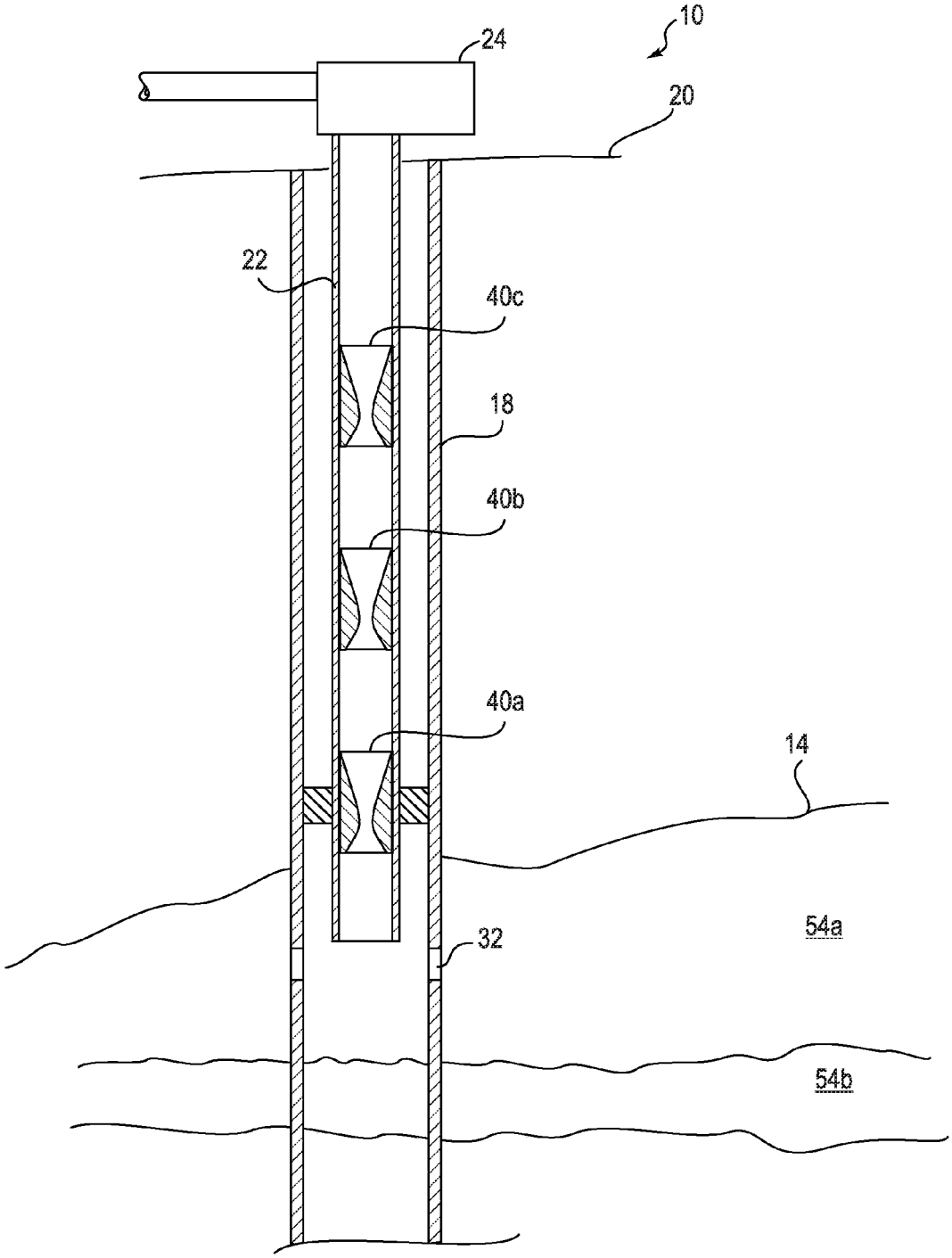
FIG. 4 is a cross-sectional view illustrating a system for deliquefying a produced fluid being produced from a gas well according to another embodiment of the present invention, including a plurality of the apparatuses of FIG. 1, 2, or 3.

It is also appreciated that some wells may benefit from the use of more than one nozzle 40 in the production tube 22. In this regard, FIG. 4 illustrates an embodiment of a system 10 having three nozzles 40*a*, 40*b*, 40*c* disposed at spaced locations along the length of the production tube 22. The produced fluid passing through the production tube 22 passes successively through each of the nozzles 40*a*, 40*b*, 40*c*. Each nozzle 40*a*, 40*b*, 40*c* is generally configured as described above and adapted to deliquefy the produced fluid. As the produced fluid flows outside of the nozzles 40*a*, 40*b*, 40*c* (i.e., before entering the first nozzle 40*a*, between the successive nozzles 40*a*, 40*b*, 40*c*, and after exiting the last nozzle 40*c*), the produced fluid may tend to liquefy. The nozzles 40*a*, 40*b*, 40*c* can be positioned at successive lengths so that the produced fluid encounters the nozzles 40*a*, 40*b*, 40*c* after some liquefaction has occurred. Thus, the deliquefying effect provided by the nozzles 40*a*, 40*b*, 40*c* can be repeated along the production tube 22, thereby further facilitating the transmission of the produced fluid therethrough.

Many modifications and other embodiments of the invention set forth herein will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed:

1. A system for deliquefying a produced fluid being produced from a gas well, the system comprising:

a production tube configured to receive produced fluid from a subsurface gas reservoir and provide a pathway for transmission of the produced fluid from a first end of the production tube adjacent to the subsurface gas reservoir and a second end near a surface location in the gas well; and at least one nozzle disposed in the production tube, the nozzle comprising a first end for receiving the produced fluid from the reservoir, a second end distal to the first end, and an inner surface extending between the first and second ends, the inner surface defining an inwardly tapered inlet portion at the first end, an outwardly tapered outlet portion proximate the second end, and a venturi neck portion between the inlet and outlet portions, wherein the production tube is configured so that all of the produced fluid passes through the at least one nozzle, and wherein the nozzle is configured to reduce the pressure of the produced fluid and thereby deliquefy the produced fluid as it passes through the nozzle, wherein liquid drops in the produced fluid are caused to become reduced in size and/or turn to a gaseous form, such that the produced fluid exiting the nozzle is better able to flow upward in the production tube.

2. The system according to claim 1, wherein the inner surface is a smooth, continuous surface extending through the inwardly tapered inlet portion, the venturi neck portion, and the outwardly tapered outlet portion, wherein an inner diameter of the venturi neck portion of the nozzle is less than one-fifth of an inner diameter of the production tube, wherein an axial length of the inwardly tapered inlet portion of the nozzle is one-half or less of an axial length of the outwardly tapered outlet portion of the nozzle, and wherein the axial length of the outwardly tapered outlet portion is at least twice the inner diameter of the production tube.

3. The system according to claim 1, wherein the nozzle is formed integrally with the production tube.

4. The system according to claim 1, wherein the system further includes connection members releasably engaging the nozzle with an inner surface of the production tube such that the nozzle is releasably disposed in the production tube.

5. The system according to claim 1, wherein the system comprises a plurality of the nozzles disposed at spaced locations along a length of the production tube such that the produced fluid passes successively through each of the nozzles and is deliquefied in each nozzle.

6. The system according to claim 1, wherein the first end of the at least one nozzle is disposed adjacent to a first end of the production tube.

7. The system according to claim 1, wherein the nozzle defines an engagement feature near the second end, the engagement feature being configured to be engaged by a retrieval tool.

8. The system according to claim 7, wherein the engagement feature is a threaded inner surface of the nozzle configured to engage corresponding outer threads of the retrieval tool.

9. The system according to claim 7, wherein the engagement feature is a slotted inner surface of the nozzle, the slot defined by a shoulder extending radially inward and configured to engage the retrieval tool.

10. The system according to claim 1, wherein the production tube is disposed in casing and is sealed from the casing by one or more packers extending circumferentially around the production tube and radially between an outer surface of the production tube and an inner surface of the casing thereby preventing produced fluid from flowing through an annulus between the production tube and the casing.

11. An apparatus for deliquefying a produced fluid being produced from a gas well through a production tube extending from a subsurface gas reservoir to a surface location and configured to provide a pathway for transmission of the produced fluid from the reservoir to the surface location, the apparatus comprising:

at least one nozzle configured to be disposed in the production tube, wherein the nozzle comprises a first end for receiving the produced fluid from the reservoir, a second end distal to the first end, and an inner surface extending between the first and second ends, the inner surface defining an inwardly tapered inlet portion at the first end, an outwardly tapered outlet portion proximate the second end, and a venturi neck portion between the inlet and outlet portions, wherein an inner diameter of the venturi neck portion is less than one-fifth of an outer diameter of the nozzle and an axial length of the inlet portion of the nozzle is shorter than an axial length of the outlet portion of the nozzle, and wherein the nozzle is configured to reduce the pressure of the produced fluid and thereby deliquefy the produced fluid as it passes through the nozzle so that liquid drops in the produced fluid are caused to become reduced in size and/or turn to a gaseous form, such that the produced fluid exiting the nozzle is better able to flow upward in the production tube.

12. The apparatus according to claim 11, wherein the inner surface is a smooth, continuous surface extending through the inlet portion, the venturi neck portion, and the outlet portion.

13. The apparatus according to claim 11, wherein the nozzle defines an engagement feature near the second end, the engagement feature being configured to be engaged by a retrieval tool.

14. The apparatus according to claim 13, wherein the engagement feature is a threaded inner surface of the nozzle configured to engage corresponding outer threads of the retrieval tool.

15. The apparatus according to claim 13, wherein the engagement feature is a slotted inner surface of the nozzle, the slot defined by a shoulder extending radially inward and configured to engage the retrieval tool.

16. A method for deliquefying a produced fluid being produced from a gas well, the method comprising:

providing a production tube receiving produced fluid from a subsurface gas reservoir, the production tube comprising a first end adjacent to a subsurface gas reservoir and a second end near a surface location in the gas well;

disposing at least one nozzle in the production tube, the nozzle comprising a first end for receiving the produced fluid from the reservoir, a second end distal to the first end, and an inner surface extending between the first and second ends, the inner surface defining an inwardly tapered inlet portion at the first end, an outwardly tapered outlet portion proximate the second end, and a venturi neck portion between the inlet and outlet portions, configuring the production tube in the gas well so that all of the produced fluids passes through the at least one nozzle to the surface location, and receiving produced fluid through the production tube along a pathway between the reservoir and the surface, wherein pressure of the produced fluid from the gas well is reduced upon passage through the nozzle, and the produced fluid is deliquefied as it passes through the nozzle, such that liquid drops in the produced fluid are caused to become reduced in size and/or turn to a gaseous form, such that the produced fluid exiting the nozzle is better able to flow upward in the production tube.

17. The method according to claim 16, wherein the step of providing the at least one nozzle comprises providing a plurality of nozzles at spaced locations along a length of the production tube such that the produced fluid passes successively through each of the nozzles and is deliquefied in each nozzle.

18. The method according to claim 16, wherein the step of providing the nozzle in the production tube comprises lowering the nozzle into the production tube while the production tube extends between the subsurface gas reservoir and the surface location.

19. The method according to claim 16, further comprising, after said receiving step, inserting a retrieval tool into the production tube, engaging the retrieval tool to the nozzle, and using the retrieval tool to move the nozzle in the production tube.

20. The method of claim 16, further comprising:

disposing the production tube in casing; and sealing the production tube from the casing by one or more packers extending circumferentially around the production tube and radially between radially between an outer surface of the production tube and an inner surface of the casing thereby preventing produced fluid from flowing through an annulus between the production tube and the casing.

21. The method according to claim 16, wherein an inner diameter of the venturi neck portion of the nozzle is less than one-fifth of an inner diameter of the production tube, wherein an axial length of the inlet portion of the nozzle is one-half or less of an axial length of the outlet portion of the nozzle, and wherein the axial length of the outlet portion is at least twice the inner diameter of the production tube.

* * * * *